US006776288B2

(12) United States Patent
Kopecky

(10) Patent No.: US 6,776,288 B2
(45) Date of Patent: Aug. 17, 2004

(54) PACKAGE FOR A CONSUMABLE PRODUCT OR THE LIKE

(75) Inventor: Stanley J. Kopecky, Prospect Heights, IL (US)

(73) Assignee: Wm. Wrigley Jr. Company, Chicago, IL (US)

( * ) Notice: Subject to any disclaimer, the term of this patent is extended or adjusted under 35 U.S.C. 154(b) by 64 days.

(21) Appl. No.: 10/001,352

(22) Filed: Oct. 31, 2001

(65) Prior Publication Data

US 2003/0080021 A1 May 1, 2003

(51) Int. Cl.[7] ..... B65D 75/00
(52) U.S. Cl. ..... 206/538; 206/800
(58) Field of Search ..... 206/461, 471, 206/528, 531, 532, 538, 539, 800

(56) References Cited

U.S. PATENT DOCUMENTS 1,984,351 A * 12/1934 Johnson ..... 206/531
3,429,426 A * 2/1969 Wolf ..... 206/531
3,743,084 A * 7/1973 Douglas ..... 206/532
6,155,454 A * 12/2000 George et al. ..... 221/25
6,253,920 B1 * 7/2001 Kallgren ..... 260/532
6,412,636 B1 * 7/2002 Jones et al. ..... 206/532

* cited by examiner

*Primary Examiner*—Jacob K. Ackun, Jr.
(74) *Attorney, Agent, or Firm*—Bell, Boyd & Lloyd LLC

(57) ABSTRACT

The present invention provides an improved product holding and dispensing package and an improved method for providing, holding and storing products, especially consumable products. The package includes a housing, a product insert and a wrapper that initially seals the outside of the housing. The housing includes an opening that enables a consumer to remove and reinsert the insert from and into the housing. When the consumer removes the insert from the housing, the consumer can remove one or more products from the insert. A compartment that holds the one or more removed products is constructed to hold its shape even after the product is removed so that the insert as a whole maintains its shape even when the insert is partially or substantially empty. The insert in a preferred embodiment slightly press-fits or biases against a number of the walls of the housing.

21 Claims, 3 Drawing Sheets

10
12
14
16
18
20
22
24
26
28
30
32
34
36
38
40
42
44
46
48
50
52
V, VI
V, VI 12
14
18
20
24
26
28
32
40
42
44
46
48
54
56
58
60
62

PACKAGE FOR A CONSUMABLE PRODUCT OR THE LIKE

BACKGROUND OF THE INVENTION

The present invention relates generally to packaging. More particularly, the present invention relates to packaging for storing and dispensing consumable products.

The packaging for consumable or confectionery products is very important to the look, marketing and storage of the product. Very often, in addition to text on the packaging, the packaging also attempts to visually convey a message about the type of product, the taste of the product or the purpose of the product. For example, packages for cinnamon or cherry tasting products are often red, grape tasting product packaging is often purple, etc. Once the consumer has identified a desired brand, the consumer can typically choose a product based solely on the color of the packaging.

In marketing the product, packaging can convey other information besides taste. For example, certain recent gum products have been developed that have an increased minty taste and that also whiten teeth and freshen breath. The packaging for these products can be made to look like a known tooth paste housing. The consumer can thereby associate the product with its effect by simply viewing the packaging.

There are also practical facets to packaging consumable products, namely, keeping the products from being damaged during shipping, keeping the products fresh, and in certain instances providing a reusable package. Some consumable products do not require that the packaging be robust, sturdy or reusable. For example, candy bars are typically eaten in a single sitting and do not require a reusable package. Candy bars therefore tend to be packaged in thin wrappers that the consumer tears open and discards.

Other consumable products are packaged in pieces and may or may not be provided in a reusable package, as desired by the manufacturer. If it is felt that only a portion of the products may be consumed in one sitting, the manufacturer may wish to provide a box having a hingedly connected lid.

Gum products are typically individually packaged in a wrapper. When the consumer desires one of the gum products, the consumer tears open the package and removes a stick or piece of gum. While known gum wrappers are adequate for most types of gum, the gum manufacturer in certain situations desires to provide a more sterile and sealed environment for the gum products.

Known gum wrappers somewhat protect the gum from ambient conditions, but they are not airtight. Also, as the consumer removes pieces from typical wrappers, the wrappers lose integrity and deform. If, for example, the gum is heated, e.g., exposed to the sun, known wrappers do not offer significant protection if the consumer sits on the gum or otherwise applies pressure to the gum package.

It is therefore desirable to provide a product package that maintains the products in an airtight or semi-airtight compartment to preserve the products and increase shelf-life.

It is also desirable to provide products in a package that is not costly but that is robust enough not to deform when less than all the products are removed from the package.

SUMMARY OF THE INVENTION

The present invention provides an improved product holding and dispensing package and an improved method for providing, holding and storing products, especially consumable products. More specifically, the present invention provides a package having a housing, an insert and a wrapper that initially seals the housing. The housing includes an opening that enables a consumer to remove and reinsert the insert from and into the housing. When the consumer removes the insert from the housing, the consumer can remove one or more products from the insert. A compartment connected to the insert holds the one or more removed products and is constructed to hold its shape even after the product is removed. The insert as a whole maintains its shape even when the insert is partially or substantially empty. The insert in a preferred embodiment slightly press-fits or biases against a number of the walls of the housing.

To this end, in an embodiment, a package for a consumable product is provided. The package includes a housing having a pair of opposing walls and an open end. An insert slides in an out of the housing. The insert includes a plurality of compartments for housing each of the products. The insert includes a plurality of sections that can be folded over against one another, which allows the insert to be removably positioned in the housing. The insert provides a force against an inner surface of the opposing walls that causes the insert to remain at least partially inside the housing when the package is moved. That is, the insert is constructed to be biased against some of the inside of the walls of the housing.

In an embodiment, the compartment is biased or press-fit against the inside of the walls of the housing.

In an embodiment, the compartment biases or press-fits against the inside of the walls of the housing even after the product is removed from the compartment.

In an embodiment, the insert creates sufficient force to prevent the insert from falling out of the housing when the package is moved in any direction.

In an embodiment, the compartment is thin walled.

In an embodiment, the compartment is plastic.

In an embodiment, the package includes a plastic wrapper that initially seals the housing.

In an embodiment, the housing includes a closed end opposing the open end.

In an embodiment, the package includes a member attached to the compartment. The member is constructed so that pressing the compartment causes the member to rupture, wherein the consumer can remove the product.

In an embodiment, the sections are hingedly attached to each other.

In an embodiment, the insert includes a member that can be ruptured and allow at least one of the products to be removed from one of the compartments.

In an embodiment, the insert is folded when inside the housing and unfolded when removed from the housing.

In an embodiment, the compartments are located on both sides of the folded insert and are adapted to hold shape after products are removed therefrom.

In an embodiment, the compartments on either side of the folded member cooperate to bias the insert against the inside of the walls of the housing.

In another embodiment of the present invention, a package for a plurality of products is provided. The package includes a housing having a pair of opposed walls, a closed end and an open end. An insert is provided that can be removably located within the housing through the open end of the housing. The insert has a plurality of compartments that store the products. The compartments are adapted to hold their shape after the products are removed from the housing. The compartments create a friction fit between the insert and the pair of opposing walls when the insert is received within the housing. The friction fit occurs both in an initial state in which each of the products are within the compartments and in a subsequent state in which one or more of the products are removed from the compartments.

In an embodiment, the products are consumable products.

In an embodiment, the products are gum.

In an embodiment, the compartments extend from a base. The base is includes flanges that seal to the member.

In an embodiment, the insert includes a second number of compartments and a second member attached to the second compartments. The second member hingedly attaches to first member. The separate compartments form a plurality of sections of the insert.

In an embodiment, the members fold together when the insert is removed and reinserted into the housing.

In an embodiment, the walls of the housing maintain their shape after the insert is removed from the package.

In another embodiment of the present invention, a method for packaging a consumable product is provided. The method includes providing an open ended housing having a removable insert, wherein the insert holds the consumable product. The insert is biased against at least some of the inner walls of the housing. The method includes removing the insert from the housing and removing some of the consumable product from the insert. The method further includes reinserting the insert and the remaining consumable product into the housing so that the insert is again biased against the at least some of the inner walls of the housing.

In an embodiment, the method includes repeating the steps of removing and reinserting until all of the consumable product is removed from the insert.

In an embodiment, the method includes providing a sealed wrapping about the housing so that the wrapping must be removed before the insert can be removed from the housing.

In an embodiment, removing some of the consumable product includes pressing and rupturing part of the insert.

It is therefore an advantage of the present invention to provide an improved package for products that is reusable.

Another advantage of the present invention is to provide an improved package for consumable products that is airtight or semi-airtight.

Further, an advantage of the present invention is to provide an improved package for consumable products that does not deform when some of the products are removed from the package.

Moreover, an advantage of the present invention is to provide an improved package for consumable products that maintains product freshness and improves shelf life.

Additional features and advantages of the present invention will be described in and apparent from the detailed description of the presently preferred embodiments.

DETAILED DESCRIPTION OF THE PRESENTLY PREFERRED EMBODIMENTS

Figure 1:
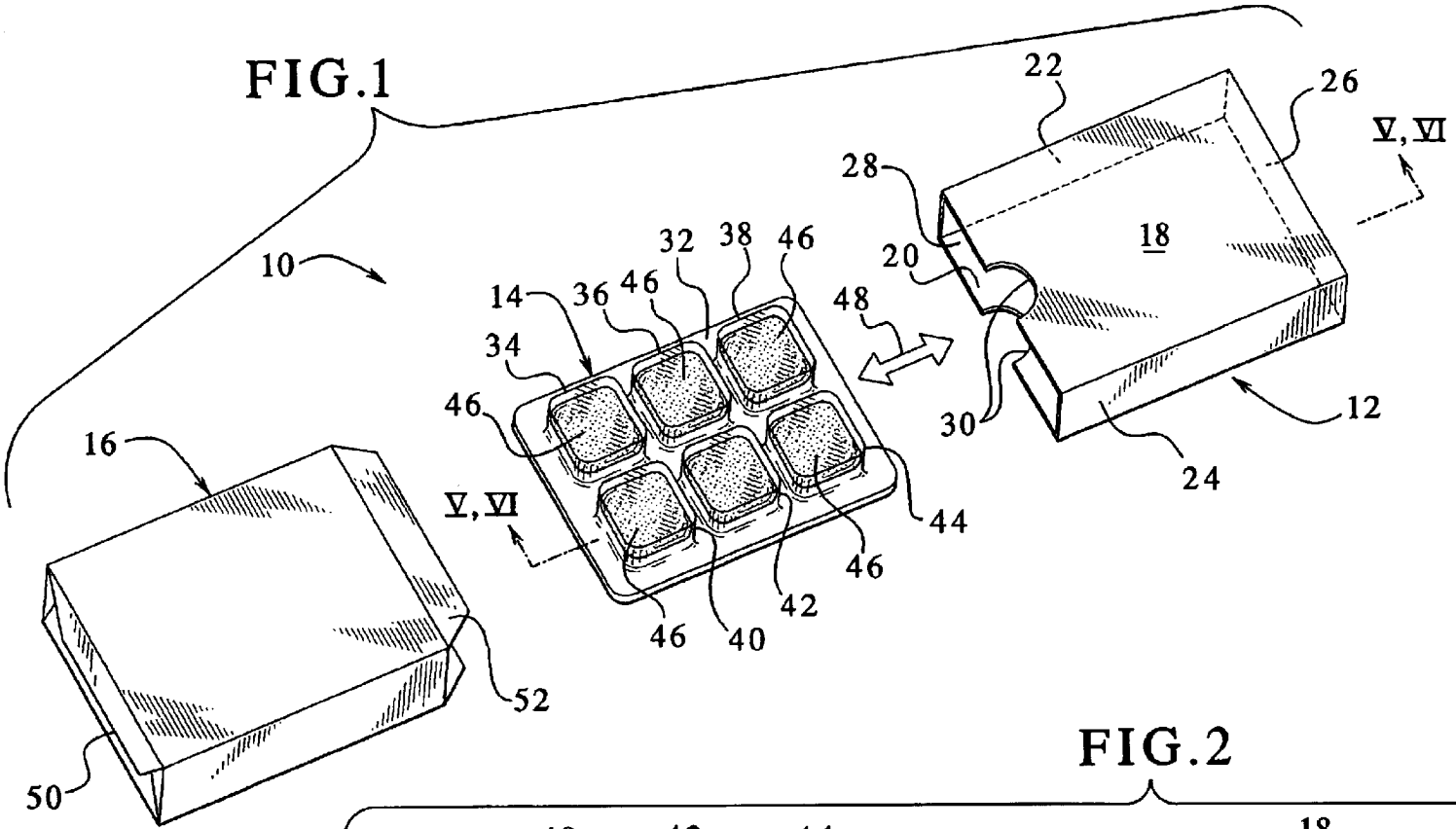
FIG. 1 is an exploded perspective view of an embodiment of the product package of the present invention.

Referring now to the drawings and in particular to FIG. 1, an embodiment of the package 10 of the present invention is illustrated. Although the package in a preferred embodiment is designed to be used to house confectionery products, e.g., gum, the package can be used to house other products, e.g., pharmaceuticals.

The package 10 includes a housing 12, and insert 14 and a wrapper 16. The insert 14 is removable and reinsertable inside the housing 12. The wrapper 16 wraps around the housing 12 and initially holds the insert 14 inside the housing 12. Once a consumer removes the wrapper 16, the consumer can thereafter discard the wrapper. The consumer then removes the insert 14 from the housing 12 and reinserts the insert as desired. The housing 12 in an embodiment is constructed of cardboard or other suitable material, such as plastic. The material for the housing 12 is preferably chosen to be relatively inexpensive and may in certain embodiments be biodegradable or recyclable. The housing 12 includes a front wall 18 and an opposing a rear wall 20, side walls 22 and 24 and a back wall 26. In one preferred embodiment, the walls define an open end or opening 28.

Although not illustrated, the housing 12 in an embodiment has a door or flap that hingedly connects to, e.g., the front wall 18 or the rear wall 20, wherein the door or flap closes or covers opening 28. In an embodiment, as illustrated, the front wall 18 and rear wall 20 define cutouts 30 that aid the consumer in handling the housing 12 and/or are for aesthetic purposes.

When the housing 12 is a paper product such as cardboard, the housing 12 in a preferred embodiment is made in a flat piece, wherein the housing folds together and holds together via interlocking flaps and/or a suitable adhesive. When the housing 12 is plastic, the desired shaped is made via a process of molding or other suitable method of mass producing plastic.

The insert 14 in an embodiment is made primarily from plastic and/or plastic or metal foils. The insert 14 includes a base 32 having flanges that surround and define a plurality of compartments 34 through 44. The compartments extend outwardly from the base 32. The compartments 34 through 44 generally hold or store a single product 46, however, in other embodiments the compartments can store multiple products 46. The base 32 is illustrated as having six extended compartments 34 through 44, however, the base 32 may be adapted to have any number of extended compartments.

In a preferred embodiment, the compartments 34 through 44 extending from the base 32 are made from a single piece of plastic along with the flanges defining the openings of the compartments. In an embodiment, the plastic is clear so that a consumer can see the products 46. In an alternative embodiment, the compartments 34 through 44 are attached to the base 32. In either case, the compartments 34 through 44 are semi-rigid structures that hold and protect the products 46 therein.

As stated above, in a preferred embodiment, the products 46 are consumable or confectionery products. The products include any type of consumable or confectionery products such as gum or candy. The products 46 can alternatively be any other type of consumable products. For instance, the products 46 can be cough drops or breath mints or other type of medical, consumable product.

As illustrated by arrow 48, the insert 14 is able to slide in and out of the housing 12. The consumer removes the insert 14 and one or more products 46 therefrom and then reinserts the insert 14 into the housing 12. As illustrated, the housing 12 in a preferred embodiment has a semi-rigid shape so that housing 12 protects the insert 14 having the plurality of compartments 34 through 44, wherein the compartments contain and additionally protect the products 46.

When package 10 is originally packaged, the manufacturer provides a wrapper 16 having ends 50 and 52 that seal and encase the housing 12. The wrapper can alternatively seal in other or additional pieces. After purchasing the products 46 contained in the package 10, the consumer tears open the wrapper 16 and thereafter discards the wrapper. Thus, while the housing 12 is reused until the products 46 are completely consumed, the wrapper 16 is discarded upon the first use of the package 10. In an embodiment, the wrapper 16 is a thin plastic sheet or plastic foil, which is preferably clear so that the consumer can see the writings and other indicia presented on the housing 12.

Figure 2:
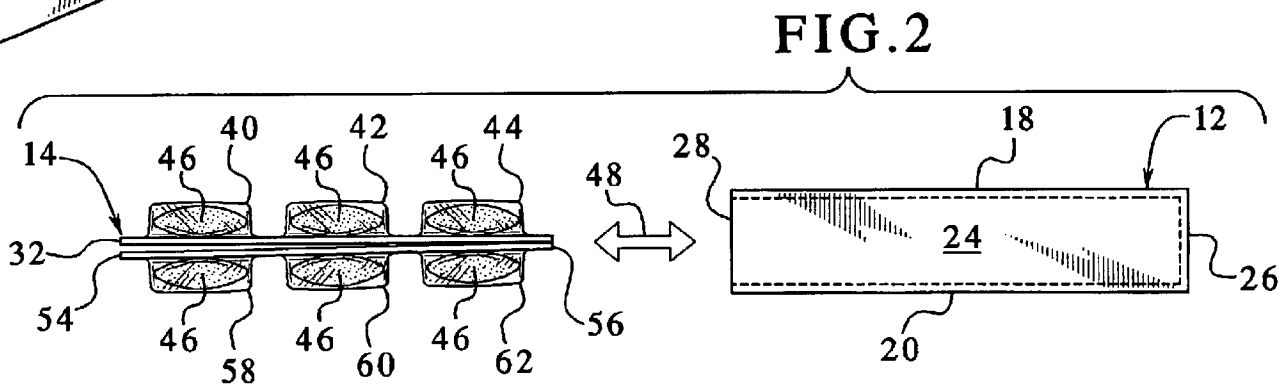
FIG. 2 is an elevation view of the package housing and insert of FIG. 1.

Referring now to FIG. 2, the housing 12 and the insert 14 of FIG. 1 are illustrated from the side. The housing 12 is shown having the front wall 18 and opposing rear wall 20, side wall 24 and back wall 26, illustrated above in FIG. 1. The housing 12 defines the opening 28 into which the insert 14 is inserted and removed as indicated by arrow 48.

In an embodiment, the insert 14 includes two sections. The sections each include a base, namely, the base 32 described above and a second base 54. The base 32 and the base 54 hingedly connect to one another. In an embodiment, the bases of the sections are comprised of a single plastic or thin metal sheet or foil that is perforated along a fold line 56. It should be appreciated that hingedly connecting the bases 32 and 54 may be done in a variety of ways as is known to those of skill in the art.

From the side, the compartments 40, 42 and 44 extend upwardly from the base 32. Products 46 reside within the compartments 40, 42 and 44. A lower set of compartments 58, 60 and 62 extend downwardly from the base 54. The compartments 58, 60 and 62 also individually include one or more products 46. In this configuration, when looking at FIGS. 1 and 2, the insert 14 as illustrated houses twelve separate products 46. Insert 14 alternatively has any desired number of compartments, products and configurations. The number of compartments extending from each base 32 and 54 can be the same, as here, or different.

When the consumer reinserts the insert 14 into the housing 12 through opening 28, the insert 14 in a preferred embodiment is biased to press against the opposing walls 18 and 20 of the housing 12. The insert 14 may also press against the side walls 22 and 24. The insert 14 is shaped and sized and the compartments are slightly deformable so that the insert 14 squeezes into the housing 12. The slight press-fit of the insert 14 into the housing 12 maintains the shape of the protective housing 12 and provides a force that will at least attempt to resist forces acting on the insert 14 to cause the insert to slip or fall out of the housing 12.

It should be appreciated that the forces exerted by the insert 14 on the housing 12 may not, in all situations, prevent the insert 14 from accidentally falling out of the housing 12. This is especially true if the housing is turned upside down so that the opening 28 faces the ground. But, the force applied by the insert 14 is preferably sufficient so that when the housing is moved, the insert will generally remain at least partially within the housing.

The compartments extending from the bases 32 and 54 are relatively rigid so that they perform their press-fit function even when the product 46 has been removed from the compartments. Therefore, even if only one product 46 remains, the insert 14 still slightly press-fits and is biased against the opposing walls 18 and 20 of the housing 12.

Figure 3:
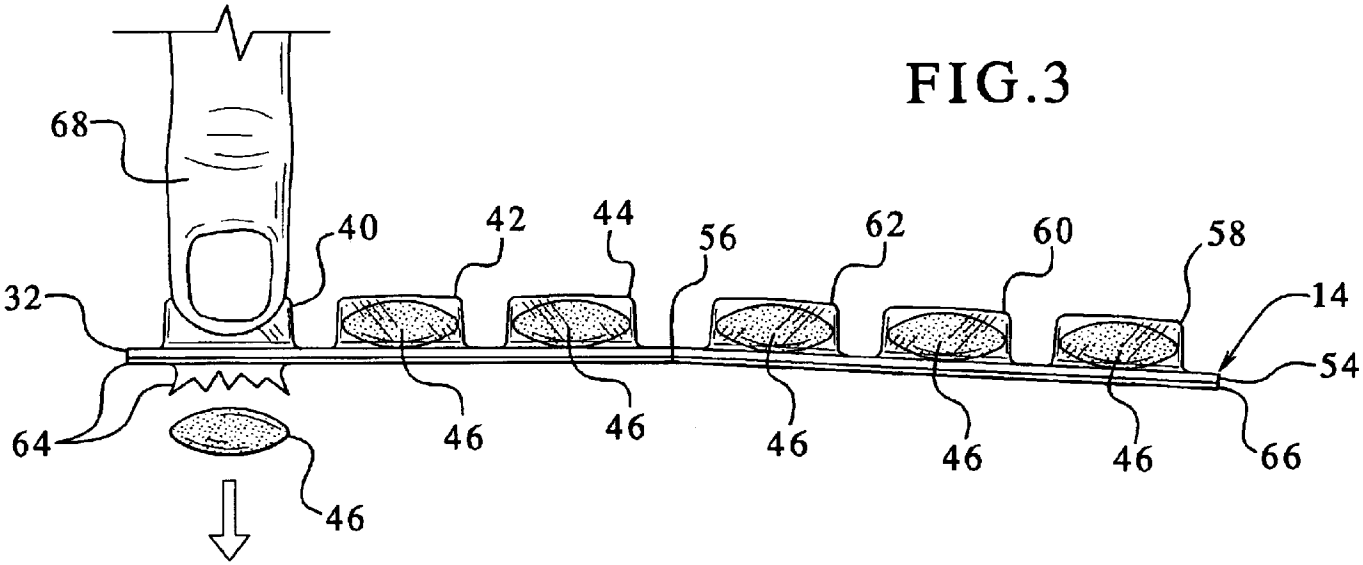
FIG. 3 is an elevation view of the product insert of FIG. 1 showing a product being dispensed from same.

Referring now to FIG. 3, the insert 14 of FIGS. 1 and 2 is shown in a product removal position. The insert 14 includes the bases 32 and 54 as described above. Compartments 40, 42 and 44 extend upwardly from the base 32. Each of the compartments 40 through 44 originally contains one or more products 46. The compartments 58, 60 and 62 extend upwardly from the base 54. Each of the compartments 58, 60 and 62 also includes one or more products 46. A member 64 applies to and preferably seals to the base 32. The member 64 in an embodiment is a thin plastic sheet or foil. The member can also be a thin metal foil having a plastic coating. In an alternative embodiment, the member 64 is a thin metal or metal coated sheet or foil. The member 64 seals to the base 32 in the flange areas that define the openings of the compartments 34 through 44. The seals maintain the products 46 in an airtight or semi-airtight environment.

A member 66 similarly attaches to and seals to flange areas of the base 54. The member 66 seals around each of the compartments, e.g., compartments 58, 60 and 62, that extend from the base 54. In an embodiment, the member 64 and the member 66 are separate plastic or metal sheets or foils. In another embodiment, the member 64 hingedly attaches to the member 66, through perforations along the fold line 56 or via another suitable method. When hingedly attached, the hinge at fold line 56 is slightly biased to spread the members 32 and the base 54 outward. The outward biasing adds to the slight positive pressure that insert 14 applies to opposing walls 18 and 20 of the housing 12.

When a consumer 68 presses or pushes one of the compartments extending from one of the bases 32 or 54, the associated member 64 or 66, respectively, ruptures so that the product 46 can be removed and enjoyed. As illustrated, the consumer 68 presses or applies pressure to the compartment 40, wherein the thin member 64 ruptures and the product 46 therein falls out. The member 64 in a preferred embodiment only ruptures within the sealing around the selected compartment. The member 64 remains unaffected in other areas that seal other products 46. When the consumer 68 removes pressure from the compartment 40, the compartment 40 in a preferred embodiment returns to its original shape as illustrated by the other compartments 42 and 44, etc. Therefore, even though the compartment 40 no longer contains the product 46, the compartment 40 still performs its function of applying a slight pressure, in combination or cooperation with the base 54 and compartments 58, 60 and 62, on the inside of the walls of the housing 12.

Figure 4:
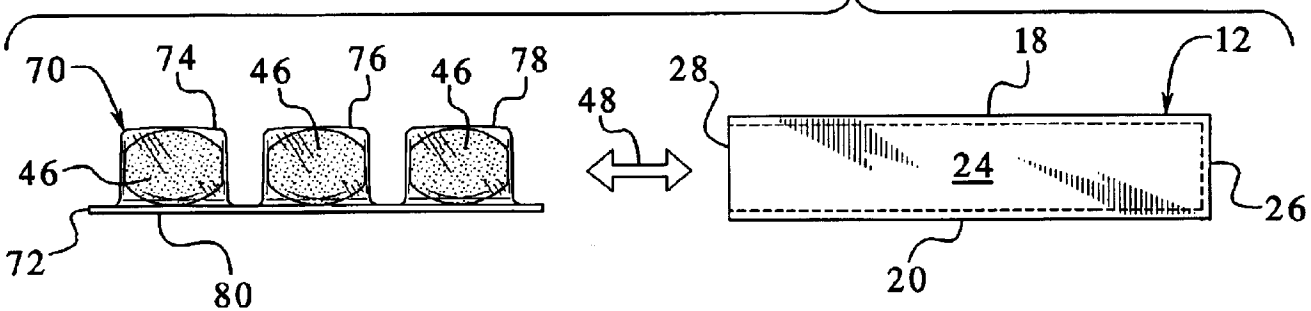
FIG. 4 is an elevation view of an alternative embodiment of the package housing and insert of the present invention.

Referring now to FIG. 4, one possible alternative embodiment for the insert of the present invention is illustrated. An insert 70 removably and reinsertably inserts, as indicated by arrow 48, into the housing 12, which is the same as the housing 12 described above. The alternative insert 70 includes a base 72 and compartments 74, 76 and 78 extending from the base 72. The base 72, like the bases 32 and 54 above, is in an embodiment plastic and may be clear plastic so that the consumer can see the products 46 stored by the compartments 74, 76 and 78.

A member 80 adheres to the base 72 and in a preferred embodiment seals to flanges of the base 72 around the compartments 74, 76 and 78. The alternative insert 70 is sized so that the single base 72, member 80 and set of compartments extending from the base 72 press-fit or bias against the inside of the walls of the housing 12. That is, the insert 70 applies a slight outward force to opposing walls 18 and 20 and alternatively, additionally to side walls 22 and 24. The alternative insert 70 can have any number of compartments that extend from the base 72. It should be appreciated that for the same size housing 12, the compartments of the alternative insert 70 have higher walls than the walls of the compartments of the insert 14. The alternative insert 70 may therefore be useful for larger products 46 or for products 46 that are most conveniently packaged in an upright or vertical position.

Figure 5:
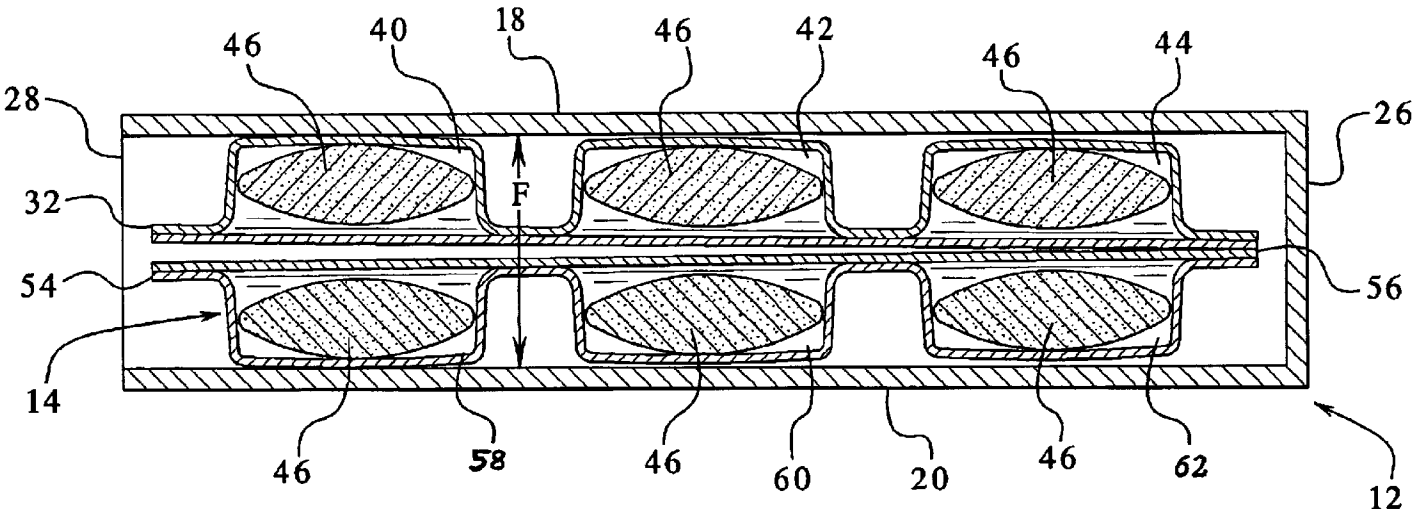
FIG. 5 is an elevation sectional view taken through the line V—V of FIG. 1, wherein the insert in an initial (full) state applies a friction force to the housing.
Figure 6:
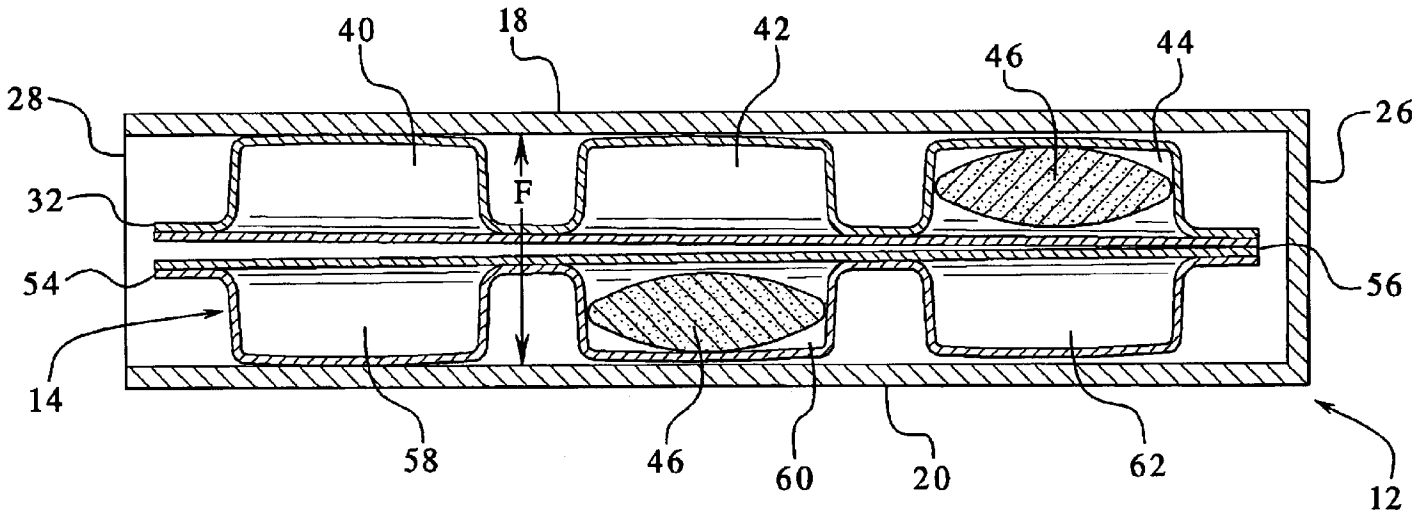
FIG. 6 is an elevation sectional view taken through the line VI—VI of FIG. 1, wherein the insert in a subsequent state (partially full) applies the same friction force to the housing.

Referring now to FIGS. 5 and 6, the housing 12 and the insert 14 of FIG. 1 are illustrated, wherein the insert 14 is inserted into the housing 12 and applies a slight friction force F to the opposing walls 18 and 20 of the housing 12. In both FIGS. 5 and 6, the housing 12 includes the front wall 18 and opposing rear wall 20, side wall 24 and back wall 26, illustrated above in FIG. 1. The housing 12 defines the opening 28 into which the insert 14 is inserted and removed. In FIG. 5, the insert 14 is in an initial state having a full load of products 46. In, FIG. 6, the insert 14 is in a subsequent state having only a partial load of products 46.

The insert 14 preferably includes two sections. The sections each include the bases 32 and 54. The base 32 and the base 54 hingedly connect to one another along the fold line 56. Products 46 reside within the compartments 40, 42 and 44 in FIG. 5 and only in the compartment 44 in FIG. 6. Regardless, the compartments 40, 42 and 44 extend upwardly from the base 32 and apply a part of the force F to the inner surface of the wall 18 in both FIGS. 5 and 6. Although the empty compartments 40 and 42 are illustrated as being in their original shape in FIG. 6, the empty compartments 40 and 42 may show signs of being deformed from the product removal process. That is, the tops of the compartments may be bowed or depressed. However, the walls or at least some of the walls of the of the compartments 40 and 42 do not deform and instead press against the inside surface of the wall 18.

A lower set of compartment 58, 60 and 62 extends downwardly from the base 54. Products 46 reside within the compartments 58, 60 and 62 in FIG. 5 and only in the compartment 60 in FIG. 6. Regardless, the compartments 58, 60 and 62 extend downwardly from the base 54 and apply a part of the force F to the inner surface of the wall 20 in both FIGS. 5 and 6. Again, although the empty compartments 58 and 62 are illustrated as being in their original shape in FIG. 6, the empty compartments 58 and 62 may show signs of being deformed from the product removal process. That is, the bottoms of the compartments may be bowed or depressed. However, the walls or at least some of the walls of the of the compartments 58 and 62 do not deform and instead press against the inside surface of the wall 20.

The hinged bases 32 and 54 are biased to separate and also apply a portion of the frictional force F to the inner surface of walls 18 and 20. It should be appreciated that the biasing of the bases 32 and 54 to come apart about the fold line 56 does not depend upon the current loading of the products 46 within the compartments. Therefore the biasing force due to the hinged bases 32 and 54 is applied regardless of how many products 46 remain in the housing 12.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A package for holding a plurality of products comprising:

a housing having a pair of opposing walls and an open end; and an insert including a plurality of compartments for housing each of the products, the insert including a plurality of sections that are folded over against one another with compartments on each section facing outwardly the insert sized with respect to the housing and removably positioned in the housing so that at least some of the compartments contact and provide multiple discrete forces against an inner surface of the opposing walls that cause the insert to remain at least partially inside the housing when the package is moved.

2. The package of claim 1, including a plastic wrapper that initially seals the housing.

3. The package of claim 1, wherein the compartments are constructed of plastic.

4. The package of claim 1, wherein the housing includes a closed end opposing the open end.

5. The package of claim 1, wherein the insert creates sufficient force to prevent the insert from falling out of the housing when the package is moved in any direction.

6. The package of claim 1, wherein the sections are hingedly attached to each other.

7. The package of claim 1, wherein the insert includes a member that can be ruptured allowing at least one of the products to be removed from one of the compartments.

8. The package of claim 1, wherein the insert is folded when inside the housing and unfolded when removed from the housing so that one of the consumable products can be removed.

9. The package of claim 8, wherein the compartments are adapted to hold shape after products are removed therefrom.

10. A package for a plurality of products comprising:

a housing having a pair of opposed walls, a closed end, and an open end; and an insert removably located within the housing through the open end of the housing, the insert having a plurality of initially sealed compartments that store the products, the compartments being constructed of a resilient material, adapted to hold their shape after the products are removed therefrom and sized with respect to the housing to thereby create a friction fit between the insert and the pair of opposing walls when the insert is received within the housing both in an initial state in which each of the products is within the initially sealed compartments and a subsequent state in which one or more of the products is removed from the compartments, which compartment is permanently unsealed.

11. The package of claim 10, which includes a member covering the compartments and so constructed and arranged that pressing one of the compartments causes a portion of the member to rupture.

12. The package of claim 10, wherein the products are consumable products.

13. The package of claim 10, wherein the products are gum.

14. The package of claim 11, wherein the insert includes a base, the compartments extending from the base and the member attaching to the base.

15. The package of claim 10, wherein the plurality of walls of the housing maintain their shape after the insert is removed from the package.

16. The package of claim 10, wherein the insert includes at least two sections each including a plurality of compartments.

17. The package of claim 16, wherein the sections are hingedly attached to each other.

18. A method for packaging consumable products comprising:

providing an open ended housing having a pair of opposing walls for housing a removable insert, the insert holding the consumable products, the insert being biased against the pair of the walls of the housing to provide a force that urges the insert to remain in the housing even when the housing is moved;

removing the insert from the housing and removing at least one of the consumable products from the insert; and reinserting the insert having the remaining consumable products into the housing so that the insert is again biased against the pair of walls of the housing, wherein an outwardly extending portion of the insert that had previously housed the removed product and at least contributed to the insert being biased against the walls continues to provide such contribution.

19. The method of claim 18, which includes repeating the steps of removing and reinserting until all of the consumable products are removed from the insert.

20. The method of claim 18, which includes providing a sealed wrapping about the housing so that the wrapping must be removed before the insert can be removed from the housing.

21. The method of claim 18, wherein removing at least one of the consumable products includes pressing and rupturing part of the insert.

* * * * *